US009399851B2

(12) United States Patent
Vo

(10) Patent No.: US 9,399,851 B2
(45) Date of Patent: Jul. 26, 2016

(54) PILING APPARATUS AND PROCESS FOR INSTALLATION OF PILE ASSEMBLY

(76) Inventor: Thanh Minh Vo, Hanoi (VN)

( * ) Notice: Subject to any disclaimer, the term of this patent is extended or adjusted under 35 U.S.C. 154(b) by 0 days.

(21) Appl. No.: 14/238,062

(22) PCT Filed: May 11, 2012

(86) PCT No.: PCT/VN2012/000001
§ 371 (c)(1),
(2), (4) Date: Feb. 10, 2014

(87) PCT Pub. No.: WO2013/110096
PCT Pub. Date: Jul. 25, 2013

(65) Prior Publication Data

US 2014/0321923 A1 Oct. 30, 2014

(30) Foreign Application Priority Data

Jan. 19, 2012 (VN) ..... 1-2012-00193

(51) Int. Cl.
*E02D 7/26* (2006.01)
*E02D 5/22* (2006.01)
*E02D 7/20* (2006.01)

(52) U.S. Cl.
CPC .. *E02D 7/26* (2013.01); *E02D 5/22* (2013.01); *E02D 7/20* (2013.01)

(58) Field of Classification Search
CPC ..... E02D 7/20; E02D 11/00; E02D 13/00; E02D 13/04
USPC ..... 405/232, 249
See application file for complete search history.

(56) References Cited

U.S. PATENT DOCUMENTS 5,419,658 A * 5/1995 DeWitt ..... 405/233
2008/0310923 A1* 12/2008 Jinnings et al. ..... 405/232

(Continued)

FOREIGN PATENT DOCUMENTS

CN 101586337 11/2009
RU 2212499 9/2003

(Continued)

OTHER PUBLICATIONS

International Search Report for PCT Application No. PCT/VN2012/000001 issued Aug. 16, 2012.
International Preliminary Report on Patentability for PCT Application No. PCT/VN2012/000001 issued Jul. 22, 2014.

*Primary Examiner* — Tara M. Pinnock
(74) *Attorney, Agent, or Firm* — Meyertons, Hood, Kivlin, Kowert & Goetzel, P.C.; Eric B. Meyertons

(57) ABSTRACT

The invention relates to a piling apparatus for pile assembly comprises at least one walled pipe (26), a clamping frame (29) having a clamping mechanism to link to a walled pipe (26) which has been inserted into the earth, a pressing stand (24) linked to the clamping frame (29), pressing cylinders (35) having one end linked to the base of pressing stand (24), another end linked to a holding clamp (18). The holding clamp (18) is used to clamp over the material, so as to force at least one material to travel throughout the interior of the walled pipe (26) by using the friction between the walled pipe (26) which has been inserted into the ground with the ground served as a counterpoise components of the apparatus are constructed to press a pressing force against material, formed by pressing cylinders (35) applied to material by means of the holding clamp (18), and a reactive force transferred via the pressing stand (24), the clamping mechanism, the clamping frame (29) to the walled pipe (26) and balanced by the friction between the walled pipe (26) and the ground. The invention further relates to an installation process for pile assembly.

15 Claims, 8 Drawing Sheets

(56) References Cited

U.S. PATENT DOCUMENTS

| | | | | |
|---|---|---|---|---|
| 2012/0097476 | A1* | 4/2012 | Jung et al. | 181/196 |
| 2012/0099931 | A1* | 4/2012 | Heichel et al. | 405/232 |
| 2012/0241039 | A1* | 9/2012 | Jung et al. | 138/155 |

FOREIGN PATENT DOCUMENTS

| | | |
|---|---|---|
| SU | 800284 | 1/1981 |
| SU | 2208088 | 10/2003 |

* cited by examiner

Fig 1
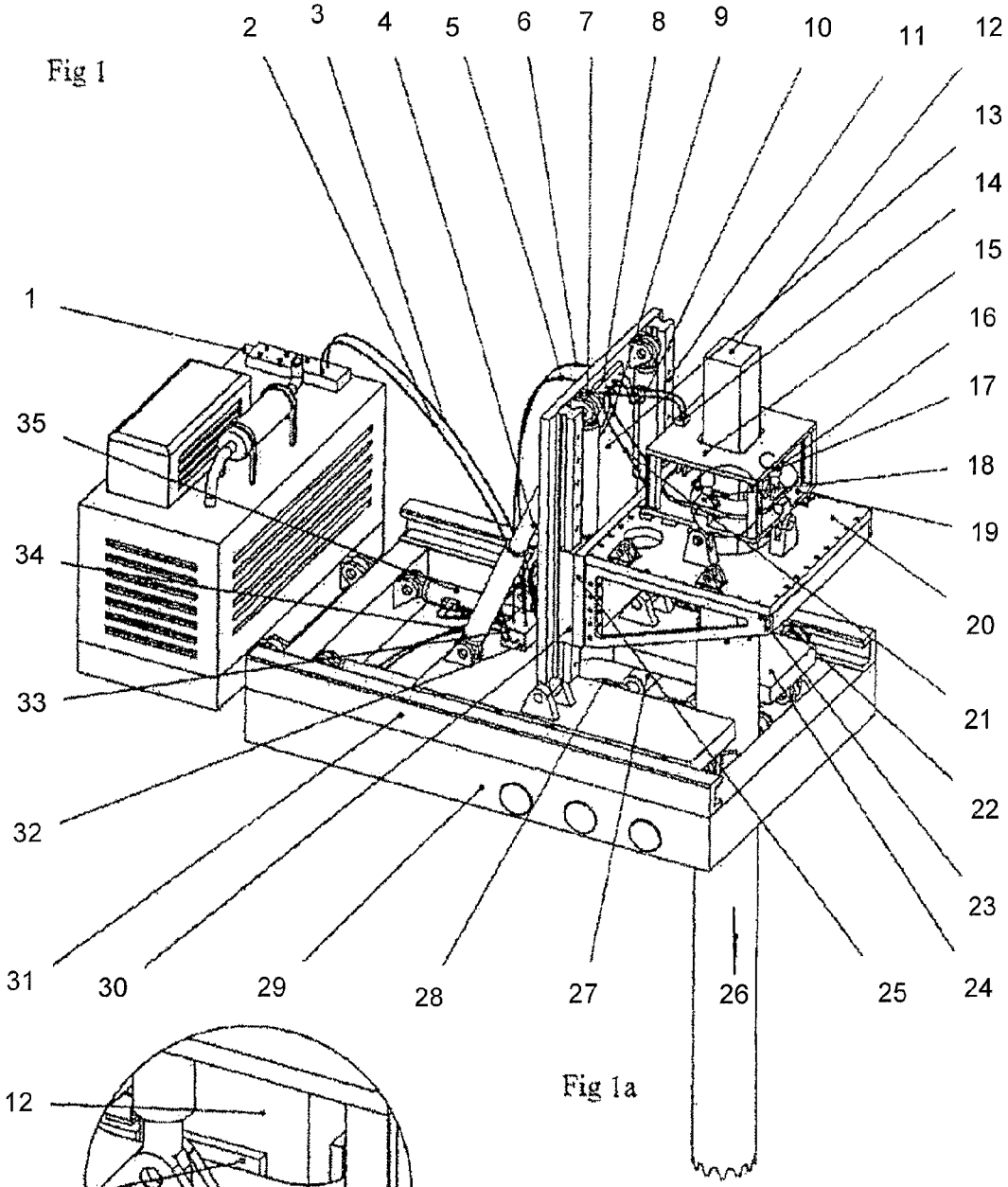
Fig 1a
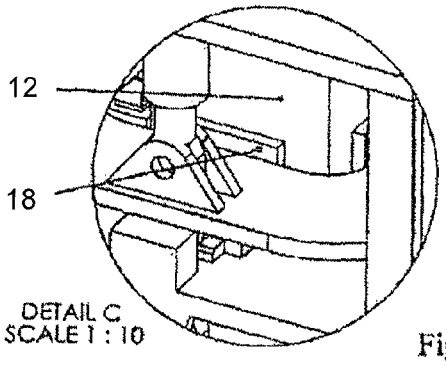
Fig 1b

Fig 2
Fig 2a
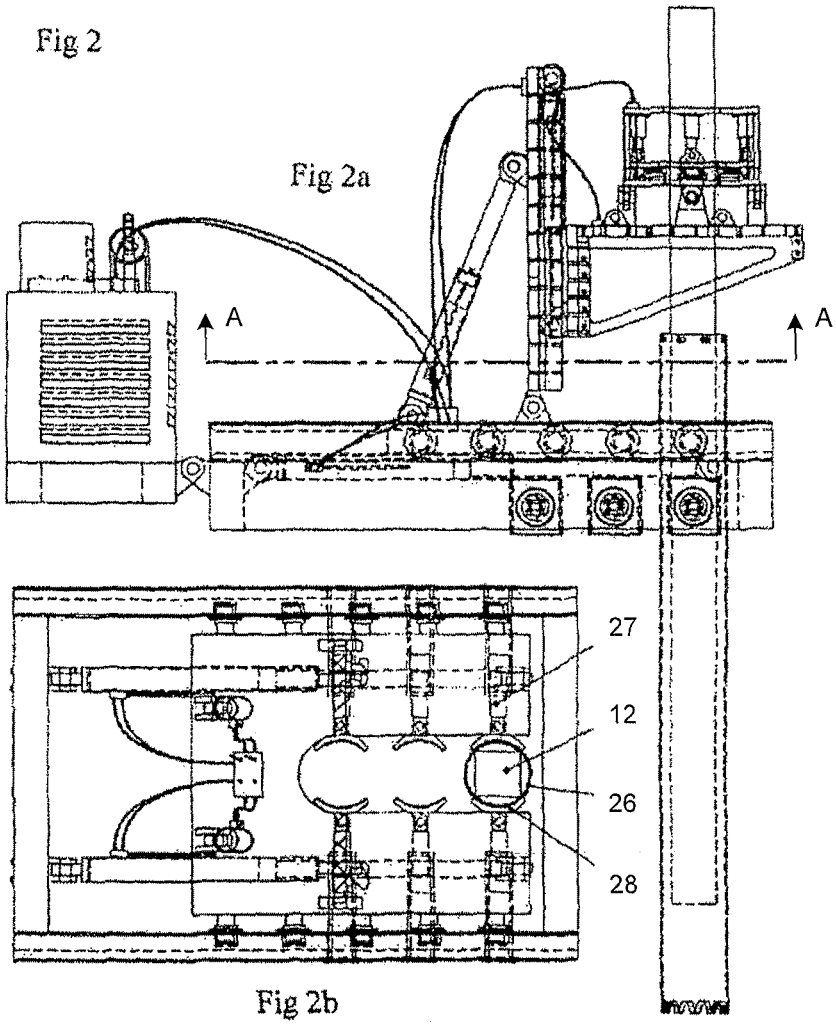
Fig 2b
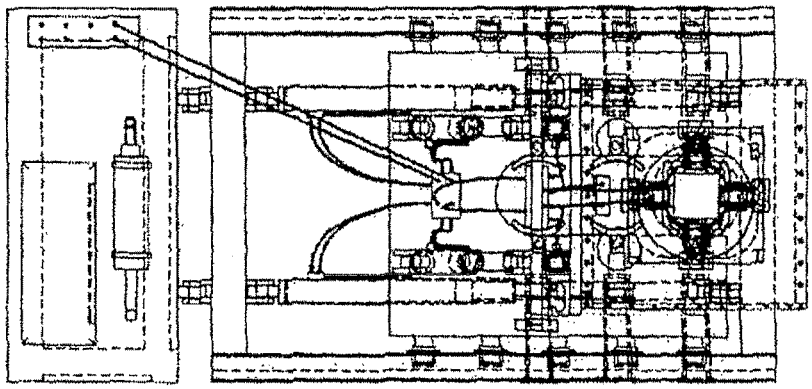
Fig 2c

Fig 3
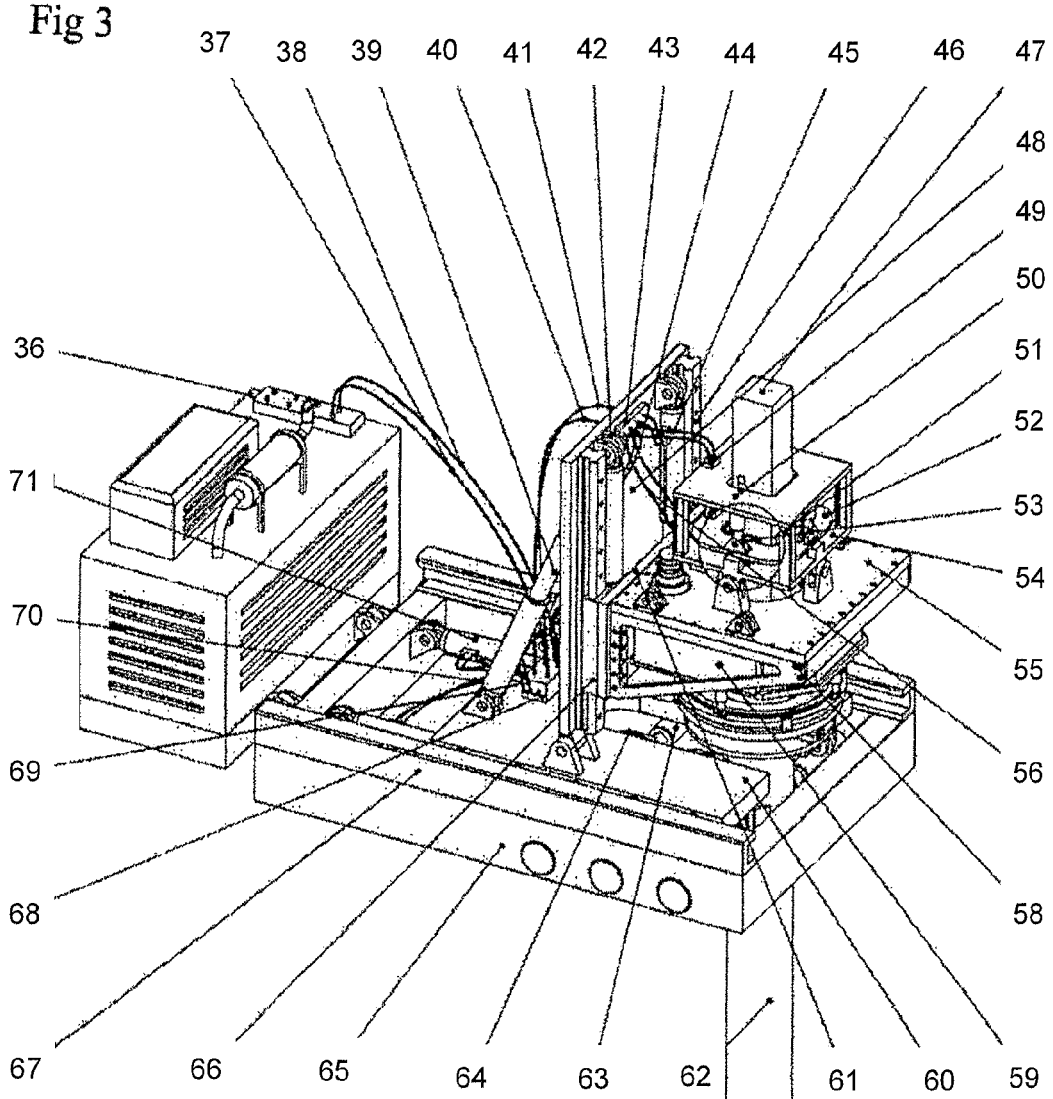
Fig 3a
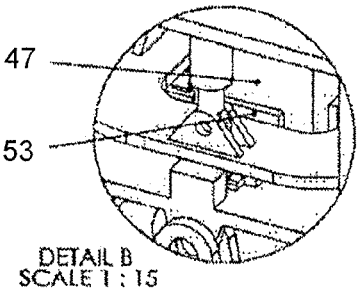
Fig 3b

Fig 4
Fig 4a
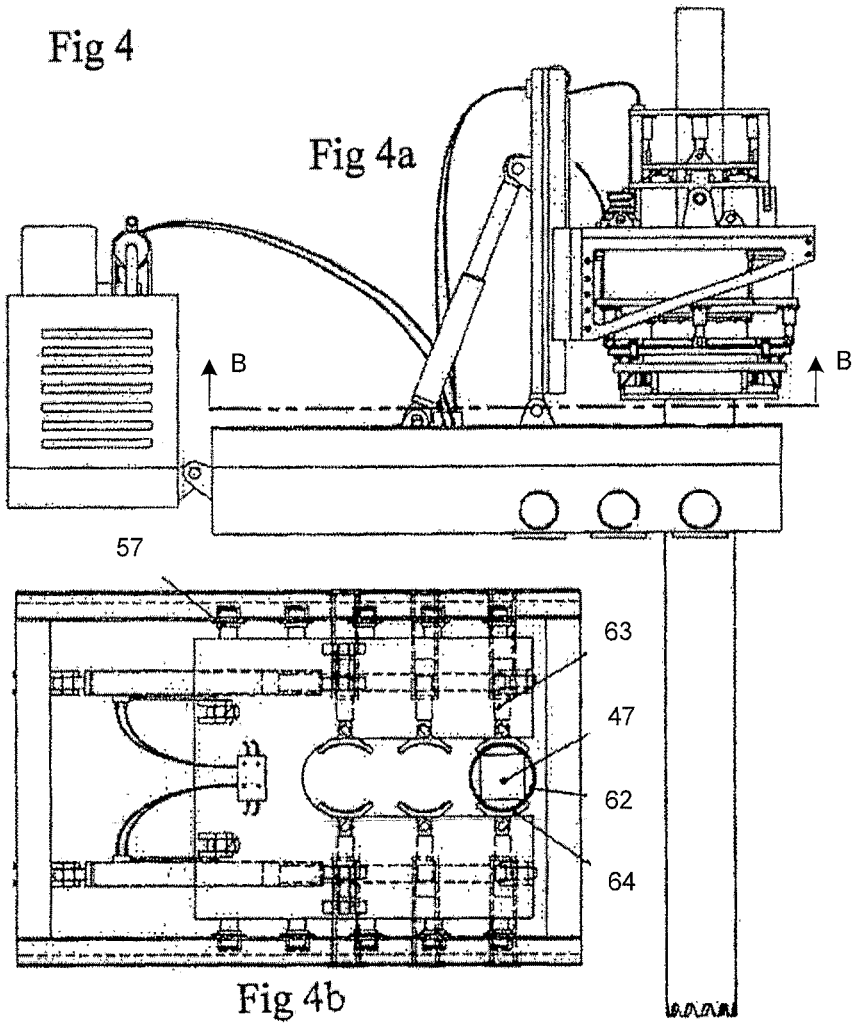
Fig 4b
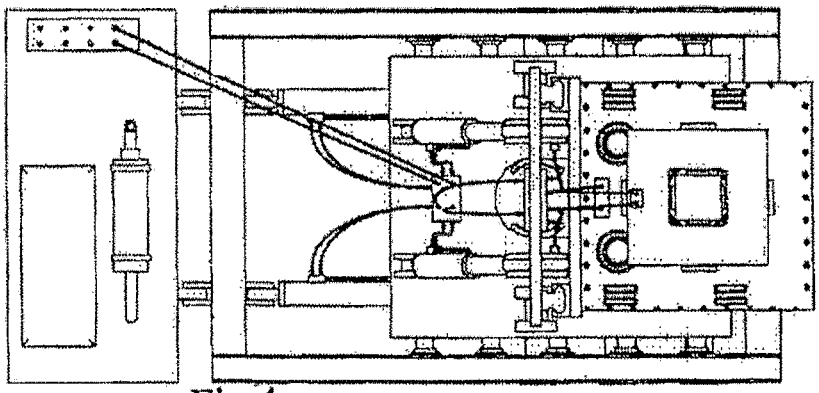
Fig 4c

PILING APPARATUS AND PROCESS FOR INSTALLATION OF PILE ASSEMBLY

TECHNICAL FIELD

The present invention relates to a piling apparatus and a process for installation of the pile assembly which can be used in the reinforcement of weak grounds, laying the foundations for the structures having different loads from low to high such as low buildings, skyscrapers, plants, bridges, seaports, airports, etc. The piling apparatus and the process of installation of the pile assembly will provide a piling comprising at least two sections of material, which have been inserted into the earth separately, wherein, the first section of material is partially disposed inside the walled pipe, the material sections other than the first ones are pressed inside the walled pipe against the ground, using the friction between the walled pipe and the ground as a counterpoise. The term "pile" as used herein should be understood as a kind of material or a combination of at least two kinds of material, which are mechanically connected to each other, being overally disposed vertically, obliquely, or horizontally and being mechanically connected to the ground.

BACKGROUND OF THE INVENTION

Laying the foundations of the structures in principal, means installation into the earth one or more kinds of different substances and/or materials in order to supplement or replace the existing soil, which itself does not satisfy the loading requirements for such structures. The substances and materials can react with or connect with the ground mechanically, chemically or both.

The introduction of the material into the earth depend on the technique which can be performed by the piling apparatus without replacing the ground, such as methods of piling or pressing the materials, or with replacing the ground such as drilling, scrapping, digging, etc. In both two cases, the replacement and the addition of the ground is always carried out by the assistance of the external forces, originated from diesel, petroleum or electric engines and therefore a counterbalance is always required to balance those forces. The counterbalance may be the apparatus' weight, the loads on it, or the friction with the ground. Those processes always result in a certain mechanical output, represented by the ratio of the minimum required energy to the actual energy of the specific apparatus and/or technique employed. When using those processes, one should consider those factors such as environmental influence, the complicatedness of the operation, the viality stability, cost-effectiveness, etc.

Among the currently existing technologies that have been used for pressing a certain material against the ground, such as các loại concrete piles, stainless steel, wooden, loose material such as sand, stone, soft material such as plastic pipe, absorbable rush, one of the popular methods is to use a counterbalance, usually the device's weight or the concrete blocks in order to balance the pressing force, the method has the following disadvantages:

- It requires a certain counterbalance as huge concrete blocks and therefore the transportation cost is large.
- It requires an appropriate construction site so that counterbalance blocks have not sunk or slanted.
- In many cases, the construction site's limitations such as the proximity to housing areas, weak ground-base, offshore construction or size limitations of counterbalance resulted in the impossible construction.

- The pressing material directly against the ground occupies the construction area and therefore may risk the neighborhood's foundations.
- The use of a single unique material from top to the bottom shall limit the effectiveness of different kinds of material.

The followings are some popular applications of foundation pilings of the engineering and constructions structures:

1. Filling-Drilling Piles

Filling-drilling piles are indepth foundations sâu, are currently widely used as foundations for structures such as skyscrapers, bridges, seaports, plants, etc., and gradually are replaced for other foundations such as driving piles.

Filling-drilling piles are widely applied because of the following advantages:

- The central load-bearing ability is high: due to the filling-drilling piles' sizes are usually bigger than other piles, the load-bearing ability of the filling-drilling piles may be a several ten times higher than the load-bearing ability of other piles.
- The construction with the filling-drilling piles is less noisy, less vibrating, especially when compared with driving piles.
- It is possible to drill into hard rock, where other kinds of piles cannot be implemented.

However, besides the above advantages, the filling-drilling piles also have some disadvantages as the followings:

- The ability to control the viality is low.
- The cost is high.
- It is environmentally polluted when using the common drilling methods with drilling solutions.
- It produces a large amount of waste dirts.
- It requires a huge amount of fresh concrete, resulting in demands for the in-site fresh concrete supply as well as the control of the concrete viality.

2. Pressing Piles

Pressing piles are pre-cast piles composed of different materials such as reinforced concrete, stainless steel, wood, or combination thereof.

Pressing piles are inserted based on the principle of using certain required pressing force, together with the necessary counterbalance formed by heavy blocks or by anchoring to the ground, which presses on one end of the pile or on the pile body.

The construction of pressing piles by pressing has the following advantages:

- Cost-effective.
- No noise is produced.
- No pollution is produced.

However, the construction of pressing piles by pressing also has the following disadvantages:

- The central load-bearing ability is low.
- The horizontal load-bearing ability is low.
- A large construction area is occupied. It is difficult to insert piles at narrow angles or small construction site.
- The pressing piles shall occupy some rooms under the ground resulting in possible breakage or sink of the neighborhood's strictures when applying the high-density pressing.

SUMMARY OF THE INVENTION

The objective of the invention is to provide a piling apparatus for pile assembly to overcome the above disadvantages of the known construction methods for installation of pile assembly, in particular to provide an apparatus to insert a walled pipe into the ground, then using the friction of the walled pipe with the ground as a counterpoise, pressing another material into the ground via the interior of the walled pipe; and then link the pressed material to the material partially disposed inside the walled pipe. The resulting pile can be either partially ground-replaced or non-ground-replaced pile.

Another objective of the invention is to provide a process of installation of pile assembly to overcome the above disadvantages of the known construction methods for installation of pile assembly.

To achieve the above objectives, the piling apparatus pile assembly according to the invention comprises at least one walled pipe, a clamping frame having a clamping mechanism to link to the walled pipe which has been inserted into the ground, pressing stand linked to the clamping frame, pressing cylinders having one end linked to the base of the pressing stand, the other end linked to a holding clamp, the holding clamp serves to clamp material tightly, and to press at least one material to travel throughout the interior of the walled pipe by using the friction between the walled pipe which has been inserted into the ground with the ground served as a counterpoise, components of the apparatus are constructed to press a pressing force against material, formed by pressing cylinders applied to material by means of the holding clamp, and a reactive force transferred via the pressing stand, clamping mechanism, clamping frame to the walled pipe and balanced by the friction between the walled pipe and the ground.

In one aspect of the invention, the present piling apparatus pile assembly has a walled pipe inserted into the ground by pressing or driving.

In yet another aspect of the invention, the piling apparatus pile assembly comprises the walled pipe inserted into the ground by vibrating in combination with pressing.

In yet another aspect of the invention, the piling apparatus pile assembly comprises the walled pipe inserted into the ground by rotating in combination with pressing.

In yet another aspect of the invention, the piling apparatus pile assembly comprises the walled pipe with two open ends.

In yet another aspect of the invention, the piling apparatus pile assembly comprises the walled pipe with one closed end.

In yet another aspect of the invention, the piling apparatus pile assembly comprises the walled pipe having cross-section unchanged along its length.

In yet another aspect of the invention, the piling apparatus pile assembly comprises the walled pipe having cross-section changed along its length.

In yet another aspect of the invention, the piling apparatus pile assembly comprises a pressing stand fixed, perpendicular to the clamping frame.

In yet another aspect of the invention, the piling apparatus pile assembly comprises a pressing stand slidable on the clamping frame by means of pushing mechanisms so as to insert a plurality of walled pipes upon one position of the clamping frame.

In yet another aspect of the invention, the piling apparatus pile assembly comprises hydraulic cylinders to adjust the angle of pressing stand, thereby to press material in a desired direction.

In yet another aspect of the invention, the piling apparatus pile assembly comprises a holding clamp clamping over the body of material by means of a wedging mechanism driven by hydraulic cylinders.

In yet another aspect of the invention, the piling apparatus pile assembly comprises a holding clamp clamping against the top of the material.

In yet another aspect of the invention, the piling apparatus pile assembly comprises material over which the holding clamp directly clamps being solid such as pre-cast concrete piles, shaped stainless steel piles, wooden piles.

In yet another aspect of the invention, the piling apparatus pile assembly comprises a holding clamp clamping over one immediate force-transferred pipe so as to transfer material being soft materials such as plastics, fabrics or loose material such as sand, macadam, and stone against the ground.

In yet another aspect of the invention, the piling apparatus pile assembly comprises a clamping frame being elongated and thereby the centers of the walled pipes are arranged on a straight line.

In yet another aspect of the invention, the piling apparatus pile assembly comprises a clamping frame of non-elongated shape and thereby the centers of the walled pipes, in the case there are not less than three walled pipes, are not arranged in a straight line.

In yet another aspect of the invention, the piling apparatus pile assembly comprises at least one walled pipe, a clamping frame having clamping mechanism to link to the walled pipe which has been inserted into the ground, a pressing stand linked to the clamping frame, pressing cylinders having one end linked to the base of the pressing stand, another end linked to a rotating end clamping over the walled pipe and the holding clamp, the rotating end clamping over the walled pipe having a wedging mechanism rotated by a hydraulic engine and a gear mechanism so as to produce a torque, tightly clamping over the walled pipe with hydraulic cylinders, with the holding clamp tightly clamping over the material, so as to force at least one material to travel throughout the interior of the walled pipe by using the friction between the walled pipe which has been inserted into the ground with the ground served as a counterpoise, components of the apparatus are constructed to press a pressing force against material, which has been formed by pressing cylinders and can be transferred to material by means of the holding clamp, and a reactive force transferred via the pressing stand, the clamping mechanism, the clamping frame to the walled pipe and balanced by the friction between the walled pipe and the ground.

The invention is further to provide an installation process for pile assembly comprising the steps of:

inserting at least one walled pipe into the ground, linking the walled pipes with the clamping frame of the walled pipe in a manner that the material pressing force is transferred via the components of the apparatus to the walled pipe and balanced by the friction between the walled pipe and the ground, inserting the materials into the interior of the walled pipe, pressing the materials to desired depth or calculated force, filling up the gap between the materials and the walled pipe with loose materials.

In yet another aspect of the invention, in the installation process for pile assembly the insertion of the walled pipe is carried out by using an independent apparatus such as driving hammer, pressing machine, vibrating hammer for pressing the material.

In yet another aspect of the invention, in the installation process for pile assembly the insertion of the walled pipe is carried out by means of pressing rotation.

In yet another aspect of the invention, in the installation process for pile assembly the friction of one walled pipe only is used to press at least one material to travel throughout said walled pipe.

In yet another aspect of the invention, in the installation process for pile assembly the friction of more than one walled pipe is used to press at least one material to travel throughout at least one of those walled pipes.

In yet another aspect of the invention, in the installation process for pile assembly, the material filling up the gap inside the walled pipe has been introduced before pressing of the material.

In yet another aspect of the invention, in the installation process for pile assembly the material filling up the gap inside the walled pipe has been introduced after pressing of the material.

The apparatus according to the present invention can install and/or insert a kind of pile assembly combined from the filling-drilling and pressing piles, wherein the friction between the walled pipe and the ground is used in the insertion of the filling-drilling piles as a counterpoise for insertion of the pressing piles, thereby to produce an effective installation process for pile assembly, and excellent pilings regarding the load-bearing ability.

When compared with the currently existing piles and piling apparatus, the piling apparatus of the invention has the following advantages:

- The energy effectiveness is high due to the utilization of the friction of the walled pipe when inserting the first material as a counterpoise for pressing the second material, thereby reducing the demand on the external counterbalance such as loading blocks, the weight of the apparatus, etc.
- The formation of the pile assembly from two or more materials enables to optimize the working productivity, the ability to control the installation/insertion viality, the viality of the piling product, to control the expenses on each material along the piling length.
- The partial replacement of the ground has reduced the requirements for stability of the ground during the replacement, for the amount of the ground to be replaced, for the amount of material to be introduced into process.

More particularly, the laying of foundations by using pile assembly are inserted by means of the apparatus according to the invention has the following advantages when compared with the known filling-drilling piles and pressing piles:

- Higher energy effectiveness compared with the filling-drilling piles.
- The control of the viality of the installation is more simple compared with the filling-drilling piles.
- Higher installation productivity compared with the filling-drilling piles.
- The load-bearing ability is more reliable compared with the filling-drilling piles.
- Less waste dirt is produced compared with the filling-drilling piles.
- The weight of the apparatus of the invention is less than that of the piling apparatus for drilling the filling piles, the arrangement for installation is simple.
- It is possible to produce the vertical load-bearing ability higher than that of the pressing piles, with the same pressing force used.
- It is possible to produce the horizontal load-bearing ability higher than that of the pressing piles.
- It is possible to use a much lighter counterbalance compared with the pressing piles for the same pressing force used.
- Less construction and installation area is occupied compared with the pressing piles.
- The installation according to the invention does not affect the neighbourhood compared with the pressing piles. Therefore, there is no need to resolve the influence on the neighbourhood foundations originated from the pressing.
- It is easier to install and/or insert the slanting piles compared with the pressing piles and the filling piles.

BRIEF DESCRIPTION OF THE DRAWINGS

FIG. 1*a* is a perspective view of the apparatus according to the invention wherein the walled pipe has been inserted into the earth by means of another apparatus.

FIG. 1*b* is an exploded view of the pile 12 and the holding clamp 18.

FIG. 2*a* is an elevation view of the apparatus of FIG. 1*a*.

FIG. 2*b* is exploded view of the apparatus of FIG. 2*a* taken according to A-A in the direction of the arrow such as of FIG. 2*a*.

FIG. 2*c* is a cross-section view of the apparatus of FIG. 1*a*.

FIG. 3*a* is a perspective view of the apparatus according to the invention wherein the walled pipe has been inserted into the earth by the apparatus of the invention.

FIG. 3*b* is an exploded view of the pile 47 and the holding clamp 53.

FIG. 4*a* is an elevation view of the apparatus of FIG. 3*a*.

FIG. 4*b* is exploded view of the apparatus of FIG. 4*a* taken according to B-B in the direction of the arrow such as of FIG. 4*a*.

FIG. 4*c* is a cross-section view of the features of FIG. 3*a*.

DETAILED DESCRIPTION OF THE INVENTION

Figure 6:
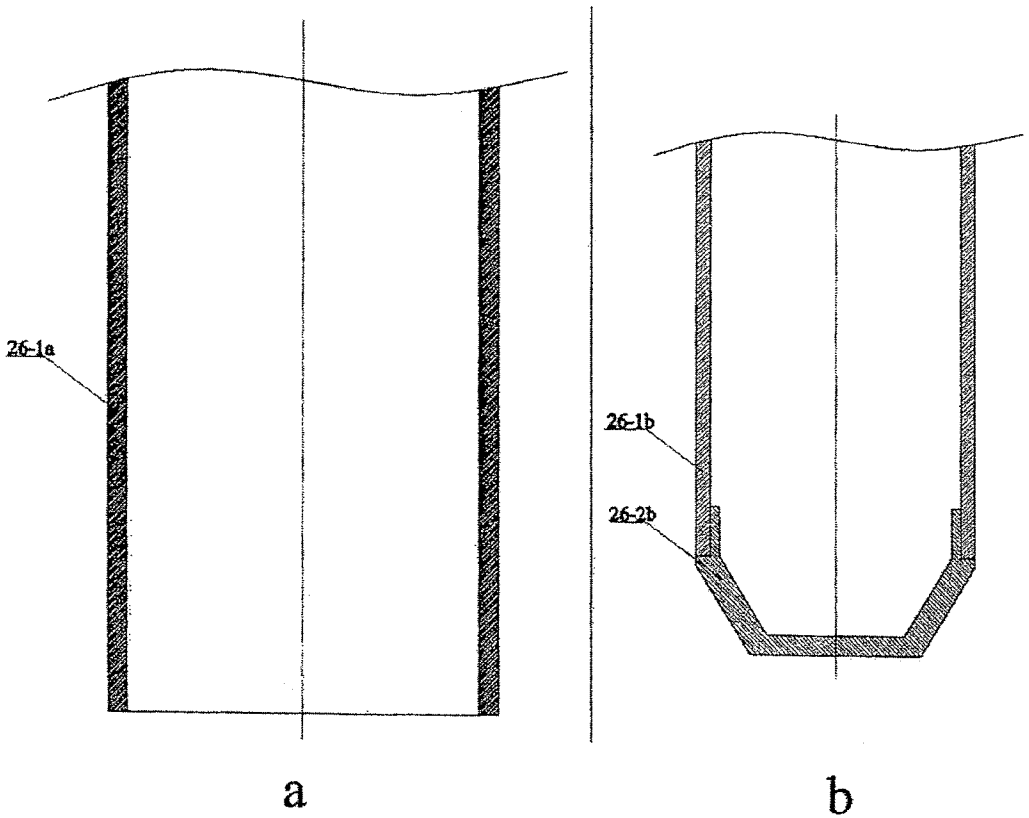
FIG. 6*a* is a view illustrating the open walled pipe.
FIG. 6*b* is a view illustrating the closed walled pipe.

According to the drawings from FIG. 1*a* to FIG. 2*c*, a piling apparatus pile assembly according to one embodiment of the invention, comprises a walled pipe 26 with two open ends (such as the walled pipe denoted as 26-1*a* of FIG. 6*a*), or with one open end (such as walled pipe denoted as 26-1*b* with a sealing bottom 26-2*b* on FIG. 6*b*). The walled pipe 26 having a circular cross-section or borders of other shape, having a cross-section regular or changed along its length has been inserted into the earth by means of another apparatus, according to method using driving hammer, vibrating hammer, pressing or a combination of rotating and pressing. The walled pipes can be arranged with the centers of the walled pipes on a straight line or a curve, the central axes of the walled pipes are parallel or angled to each other, such as on FIG. 7*a*, FIG. 7*b*, FIG. 7*c*, FIG. 7*d*. On FIG. 7*a*, a pile (that will be described in more details below) was denoted as 7-1*a*, a walled pipe was denoted by the reference numeral 7-2*a*. On FIG. 7*b* a pile (that will be described in more details below) was denoted as 7-1*b*, a walled pipe was denoted by the reference numeral 7-2*b*. On FIG. 7*c* a pile (that will be described in more details below) was denoted as 7-1*c*, a walled pipe was denoted by the reference numeral 7-2*c*. On FIG. 7*d* a pile (that will be described in more details below) was denoted as 7-1*d*, a walled pipe was denoted by the reference numeral 7-2*d*.

The interior of the walled pipe 26 was emptied, by using the walled pipe with one open end, or in the case of the walled pipe with two open ends, by using of the apparatus such as driller, pump, digging bucket to remove the dirt from inside the walled pipe 26.

Figure 8:
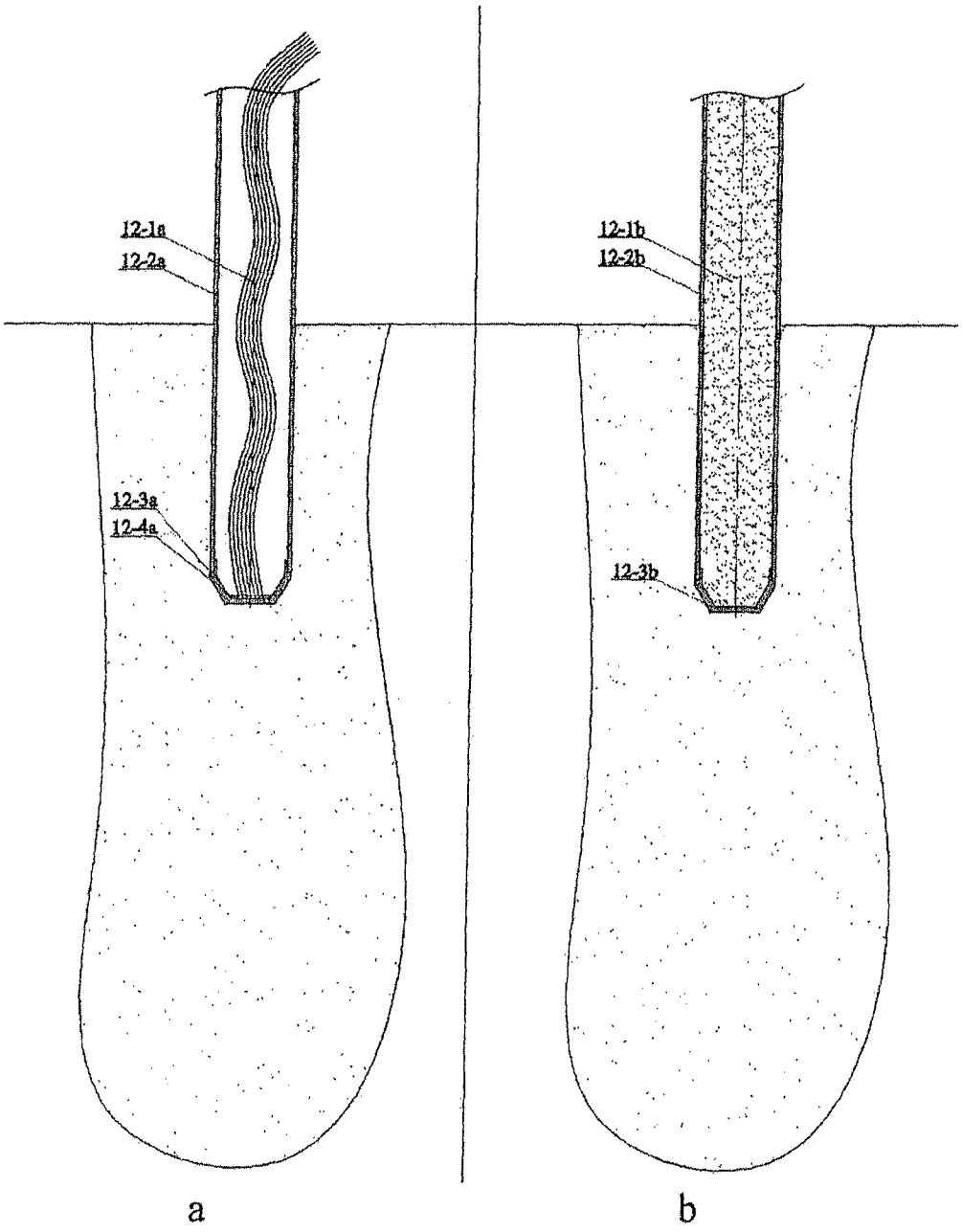
FIG. 8*a* is a view illustrating an intermediate force transferring pipe to press the fibre soft materials.
FIG. 8*b* is a view illustrating an intermediate force transferring pipe to press the particulate losse materials.

Pile 12, was precast by concrete, stainless steel, wood, or being an intermediate force transferring pipe such as FIGS. 8*a* and 8*b* was lifted by a crane, dropped downwardly into the interior of the walled pipe 26, until the pipe end reached the bottom. FIG. 8*a* illustrates the intermediate force transferring pipe pressing the fibre soft materials together with the fibre material was denoted by the reference numeral 12-1*a*, a body of the force transferring pipe was denoted as 12-2*a*, a bottom of the force transferring pipe with the reference numeral 12-3*a* and a link panel 12-4*a* linking the fibre material 12-1*a* with the bottom of the force transferring pipe 12-3*a*. FIG. 8*b* illustrates the intermediate force transferring pipe pressing the particulate losse materials with the particulate losse materials was denoted as 12-1*b*, a body of the force transferring pipe was denoted as 12-2*b* and a bottom of force transferring pipe was denoted as 12-3*b*.

The hydraulic oil from the hydraulic source 1 was transferred via tuyeres 2 and 3 to a distribution unit 32. From the distribution unit 32 the hydraulic oil was distributed via tuyeres 5 and 6 to be transferred to splitter 8.

From the distribution unit 32, the oil was transferred to cylinder 35 by means of tuyere 34 causing cylinder 35 carrying the pressing stand 24 to move along rail 31 (fixedly mounted on the clamping frame 29) by means of wheel 22, carrying the pressing stand 24 to the position of the walled pipe 26.

From the distribution unit 32, the hydraulic oil was supplied to cylinder 4 via tuyere 33 causing cylinder 4 carrying the sliding frame of the pressing stand 13 to rotate about the base of the pressing stand 24, until reaching the pile pressing angle 12 as designed.

From splitter 8, the hydraulic oil was distributed via tuyere 10 to the tuyere flange 14. Then the oil was continuously supplied to the clamping cylinder 17 fixed on the force-resistant flange 15. Cylinder 17 moved upwards and downwards carrying the holding clamp 18 in order to tightly clamp (or to loosen) pile 12.

From splitter 8, the hydraulic oil was supplied to cylinder 7 by means of tuyere 9 causing the cylinder 7 to move upwards and downwards. Cylinder 7 carrying a sliding clamp 30 moved upwards and downwards along a sliding arm 11 fixedly mounted on the sliding frame 13. The sliding clamp 30 carrying a connecting arm 25, a reinforcing unit 23, a supporting flange 20, a supporting frame 19, a holding clamp 18, a clamping cylinder 17, a force-resistant frame 16, a force-resistant flange 15, a tuyere flange 14 moved together upwards and downwards, causing the pile 12 to move downwardly (when being pressed), or upwardly (when being drawn) in accordance with a specific direction, specific coordinates to the designed depth or pressing/drawing force.

From the distribution unit 32, the hydraulic oil was supplied to the clamping cylinder 27 causing the clamping cylinder 27 to move outwardly (to tightly clamp) or inwardly (to loosen) the walled pipe 26.

According to the drawings from FIG. 3*a* to FIG. 3*c*, the piling apparatus pile assembly according to another embodiment the invention comprises the walled pipe 26 having two open ends (such as the walled pipe denoted as 26-1*a* of FIG. 6*a*), or with one open end (such as the walled pipe denoted as 26-1*b* with a sealing bottom 26-2*b* of FIG. 6*b*), the walled pipe 26, having a circular cross-section or other shape, a regular or changed cross-section along its length, has been inserted into the earth by the apparatus according to the invention, by means of the method using driving hammer, vibrating hammer, pressing or a combination of rotating and pressing. The walled pipes can be arranged with the centers of the walled pipes on a straight line or a curve, the central axes of the walled pipes are parallel or angled to each other, as illustrated on FIG. 7*a*, FIG. 7*b*, FIG. 7*c*, FIG. 7*d*). On FIG. 7*a*, the pile (which shall be described in more details below) was denoted as 7-1*a*, the walled pipe was denoted by the reference numeral 7-2*a*. On FIG. 7*b* the pile (which shall be described in more details below) denoted as 7-1*b*, the walled pipe was denoted by the reference numeral 7-2*b*. On FIG. 7*c* the pile (that will be described in more details below) was denoted as 7-1c, the walled pipe was denoted by the reference numeral 7-2*c*. On FIG. 7*d* the pile (that will be described in more details below) was denoted as 7-1*d*, the walled pipe was denoted by the reference numeral 7-2*d*.

The interior of the walled pipe 62 was emptied, by using the walled pipe with one open end, or in the case of the walled pipe with two open ends, by using of the apparatus such as driller, pump, digging bucket to remove the dirt from inside the walled pipe 26.

Pile 47, is precast by concrete, stainless steel, wood, or being an intermediate force transferring pipe such as illustrated on FIG. 8*a* and FIG. 8*b*, was lifted by a crane, dropped downwardly into the interior of the walled pipe 62, until the pipe end reached the bottom. FIG. 8*a* illustrates the intermediate force transferring pipe for pressing the fibre soft materials together with the fibre material as denoted by the reference numeral 12-1*a*, a body of the force transferring pipe denoted as 12-2*a*, a bottom of the force transferring pipe as denoted by the reference numeral 12-3*a* and a link panel 12-4*a* for linking the fibre material 12-1*a* with the bottom of the force transferring pipe 12-3*a*. FIG. 8*b* illustrates the intermediate force transferring pipe for pressing the particulate losse materials with the particulate losse materials denoted as 12-1*b*, the body of the force transferring pipe denoted as 12-2*b* and the bottom of the force transferring pipe denoted as 12-3*b*.

The hydraulic oil from the hydraulic source 36 was transferred via tuyere pipes 37 and 38 to the distribution unit 68. From this distribution unit 68 the hydraulic oil was distributed via the tuyere pipes 40 and 41 to be transferred to splitter 43.

From distribution unit 68, the oil was transferred to cylinder 71 by means of the tuyere pipe 70 causing cylinder 71 carrying the pressing stand 60 tp move along rail 67 (fixedly mounted on clamping frame 65) by means of wheel 57, carrying the pressing stand 60 to the position of the walled pipe.

From the distribution unit 68, the hydraulic oil was supplied to cylinder 39 via tuyere pipe 69 causing cylinder 39 carrying the sliding frame of the pressing stand 48 to rotate about the base of the pressing stand 60, until reaching the pile pressing angle 47 as designed.

From splitter 43, the hydraulic oil was distributed via the tuyere pipe 45 to a tuyere flange 49. Then the oil was continuously supplied to the clamping cylinder 52 fixed on the force-resistant flange 50. Cylinder 52 moved upwards and downwards carrying the holding clamp 53 to tightly clamp (or to loosen) the pile 47.

From splitter 43, the hydraulic oil was supplied to cylinder 42 by means of tuyere 44 causing cylinder 42 to move upwards and downwards. Cylinder 42 carrying the sliding clamp 66 moved upwards and downwards along the sliding arm 46 fixedly mounted on the sliding frame 48. The sliding clamp 66 carrying the connecting arm 61, the reinforcing unit 58, the supporting flange 55, the supporting frame 54, the holding clamp 53, the clamping cylinder 52, the force-resistant frame 51, the force-resistant flange 50, the tuyere flange 49 moved together upwards and downwards, causing the pile 46 to move downwardly (when being pressed), or upwardly (when being drawn) in accordance with a specific direction, specific co-ordinates to the designed depth or pressing/drawing force.

Gear box 59 was fixedly mounted on the supporting flange 55, therefore when moving upwards and downwards cylinder 42 shall carry gear box 59 to move in accordance with a specific direction and co-ordinate.

From splitter 43, the oil was transferred via the tuyere pipe 56 to gear box 59 causing the gear box to rotate (about one specific axis) and to tightly clamp (or to loosen) the walled pipe 62 as follows (according to FIG. 5):

Cylinder 59-5 moved upwards and downwards carrying a bearing pressing frame 59-6, a pressing bearing 59-10, a bearing supporting frame 59-7, a pressing wedge 59-8 to move upwards and downwards, accordingly. The pressing wedge 59-8 moved upwardly (to loosen) or downwardly (to tightly clamp) causing a clamping wedge 59-9 to move in accordance with the clamping direction in order to loosen or to tightly clamp over the walled pipe 62. When the clamping wedge was clamping over the walled pipe 62, if the gear box moved upwards and downwards in accordance with one specific direction, then the walled pipe 62 shall also be moving upwards and downwards accordingly.

The hydraulic engine 59-1 was fixed on the gear box cover 59-3. A gear 59-11 was carried by a bearing 59-12 fixedly placed in the gear box body 59-4 and prevented from moving in the vertical direction by means of a bearing block cap 59-2 fixedly mounted on the gear box cover 59-3. The hydraulic engine rotated causing 59-11 to rotate accordingly. The gear 59-11 fixedly mounted on the rotating axis 59-14 therefore when the gear 59-11 rotated, it made the rotating axis 59-14 to rotate accordingly. A transferring axis 59-13 was fixed with the rotating axis 59-14, therefore the transferring axis shall rotate following the rotation of the rotating axis 59-14. The transferring axis 59-13 rotated making the bearing holder 59-7, the pressing wedge 59-8 and the clamping wedge 59-9 to rotate accordingly. If the clamping wedge 59-9 was tightly clamping over the walled pipe 62 then the clamping wedge's rotation shall make the walled pipe 62 to rotate accordingly.

Figure 5:
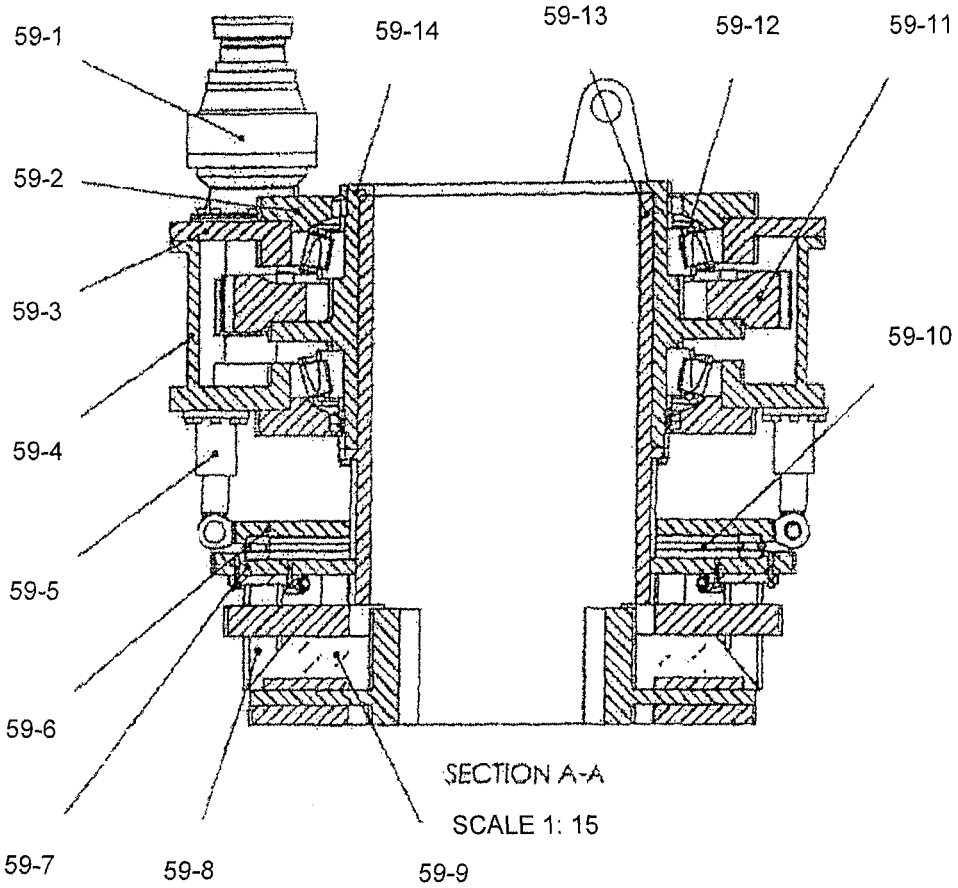
FIG. 5 is a perspective view of the gear box 59 illustrating the structure of the rotating end clamping over the walled pipe.
Figure 7:
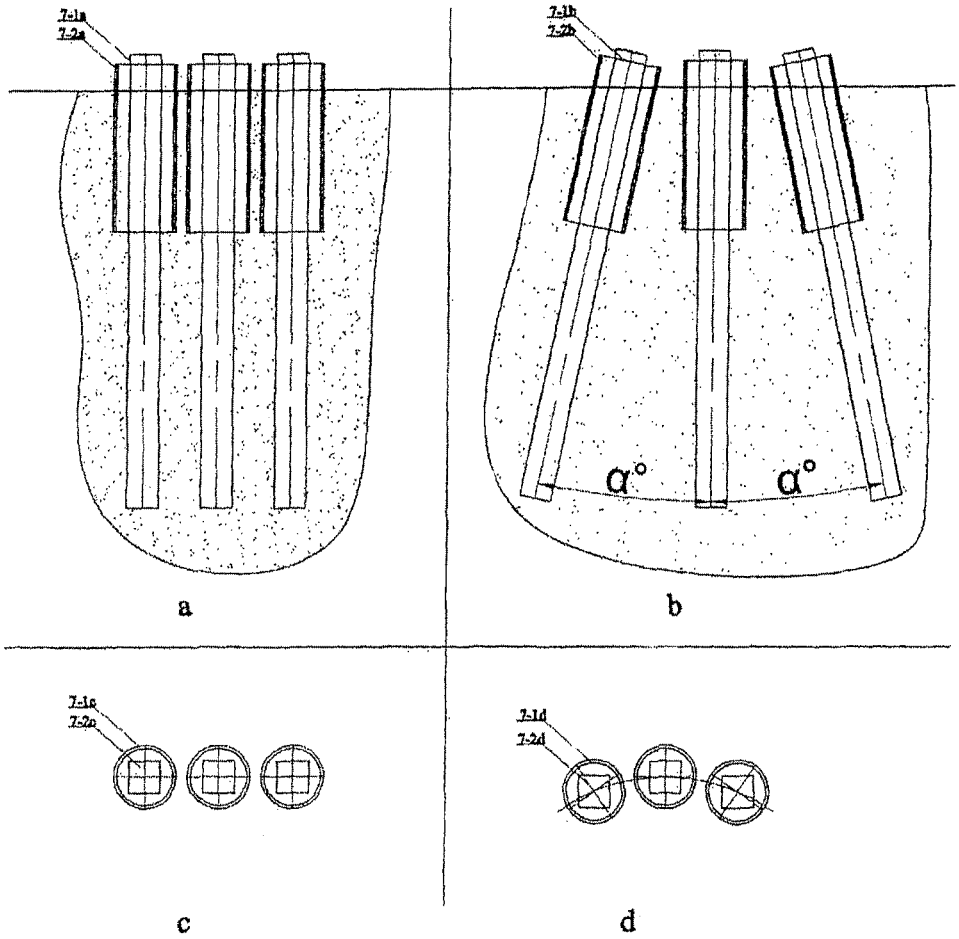
FIG. 7*a* is a view illustrating the case when the pressing stand control cylinder is not used.
FIG. 7*b* is a view illustrating the case when the pressing stand control cylinder is used.
FIG. 7*c* is a view illustrating the case when the centers of the walled pipes are arranged on a straight line.
FIG. 7*d* is a view illustrating the case the centers of the walled pipes are arranged on a curve.

The installation process according to the invention is performed in the following manner:

The installation process for pile assembly according to the invention comprises the steps of:

Selecting the number of the walled pipes, the type of the with two open ends or with one open end according to FIG. 6*a* or FIG. 6*b*, having a regular or changed cross-section, selecting the method for insertion of the walled pipe by means of independent devices such as vibrating hammer, driving hammer, pressing machine for the walled pipe or by using the apparatus according to FIG. 3*a* to insert the walled pipe into the earth;

Selecting the material to be pressed into the earth which can be hard materials such as pre-cast concrete piles, stainless steel piles, wooden piles or soft materials according to FIG. 8*a*, FIG. 8*b*, wherein the materials pressed may be different from the walled pipes, and the number of the materials pressed into the earth may be different from the number of the walled pipes, some walled pipes may not have any materials pressed in and some walled pipes may have more than one material pressed in, depending on the construction requirements;

Selecting the arrangement of the piles in vertical direction or slanting direction, the arrangement of the centers of the walled pipes on a straight line or a curve according to FIG. 7;

Selecting the type of material to be filled in the gap between the walled pipe and the materials are pressed into the earth;

Inserting the walled pipes into the earth, linking the walled pipes to the clamping frame of the apparatus according to FIG. 2 or FIG. 3. In the case of the walled pipe with two open ends according to FIG. 6, removing the dirt from the walled pipe, by means of independent devices such as driller, scrapping bucket, pump or use of the apparatus itself as illustrated on FIG. 3, if the apparatus on FIG. 3 was used for rotating, pressing and inserting the walled pipe;

Linking the walled pipes to the clamping frame 1 of the pressing machine according to FIG. 1 or FIG. 5 by nuts 61;

Inserting the selected materials into the interior of the walled pipe, until reaching the bottom;

Clamping the holding clamps 53 according to FIG. 1 or FIG. 5 over the material body Using hydraulic cylinders or pressing a pre-determined force on the top of the material, using the hydraulic cylinders 7 according to FIG. 1 or FIG. 5, until the cylinder has finished its itinerary;

Adding the material units until achieving a desired depth or pressing force;

Filling the gap between the pressed material and the walled pipe, if any, by any flexible materials such as mortar, concrete, or sand, wherein the filling can be carried out before or after the pressing of the material.

The invention claimed is:

1. A piling apparatus for pile assembly, comprising:

at least one walled pipe;

a clamping frame having a clamping mechanism to link to at least one walled pipe after the at least one walled pipe has been inserted into the ground;

a pressing stand linked to the clamping frame;

pressing cylinders having one end linked to the pressing stand, and the other end linked to a holding clamp, wherein the holding clamp is used for clamping the pressing cylinders to a pile, wherein, during use, the pressing cylinders force the pile to travel through the interior of the walled pipe using the ground as a counterpoise;

wherein the pressing stand is slidable on the clamping frame by means of pushing mechanisms so as to insert a plurality of walled pipes from one position of the clamping frame;

wherein the clamping frame is not elongate and wherein, when three or more walled pipes are used, the centers of the walled pipes are not arranged in a straight line; and wherein components of the apparatus are constructed to:

apply a pressing force against the pile using the pressing cylinders which apply a pressing force through the holding clamp;

apply a reactive force which is: transferred via the pressing stand, the clamping mechanism, the clamping frame to the walled pipe; and balanced by the friction between the walled pipe and the ground.

2. The apparatus according to claim 1, wherein the walled pipe has been inserted into the ground by pressing or driving.

3. The apparatus according to claim 1, wherein the walled pipe has been inserted into the ground by vibrating in combination with pressing.

4. The apparatus according to claim 1, wherein the walled pipe has been inserted into the ground by rotating in combination with pressing.

5. The apparatus according to claim 1, wherein the walled pipe has two open ends.

6. The apparatus according to claim 1, wherein the walled pipe has one closed end.

7. The apparatus according to claim 1, wherein the walled pipe has a cross-section unchanged along its length.

8. The apparatus according to claim 1, wherein the walled pipe has a cross-section changed along its length.

9. The apparatus according to claim 1, wherein the pressing stand is fixed, perpendicular to the clamping frame.

10. The apparatus according to claim 1, wherein the pressing cylinders are capable of adjusting the angle of the pressing stand, thereby pressing the materials in a desired direction.

11. The apparatus according to claim 1, wherein, during use, the holding clamp clamps over a pile by means of a wedging mechanism driven by the pressing cylinders.

12. The apparatus according to claim 1, wherein, during use, the holding clamp clamps over the top of a pile.

13. The apparatus according to claim 1, wherein the holding clamp clamps over an intermediate force transferring pipe so as to insert one or more piles into the ground when the piles are formed from plastics, fabrics, sand, macadam, or stone.

14. A piling apparatus for pile assembly comprising:

at least one walled pipe;

a clamping frame having a clamping mechanism to link to at least one of the walled pipes after the at least one walled pipe has been inserted into the ground a pressing stand linked to the clamping frame;

pressing cylinders having one end linked to the pressing stand, and the other end linked to a rotating end clamp coupled to at least one of the walled pipes and a holding clamp;

wherein the rotating end clamp comprises a wedging mechanism, rotated by means of a hydraulic engine, and a gear mechanism which together produce a torque which clamps the rotating end clamp to the walled pipe;

wherein the holding clamp clamps a pile wherein the pile travels throughout the interior of the walled pipe by using the friction between the walled pipe, which has been inserted into the ground, with the ground served as a counterpoise wherein components of the apparatus are constructed to:

apply a pressing force against the pile using the pressing cylinders which apply a pressing force through the holding clamp, and;

apply a reactive force which is: transferred via the pressing stand, the clamping mechanism, the clamping frame to the walled pipe; and balanced by the friction between the walled pipe and the ground.

15. The piling apparatus of claim 14, wherein the pressing stand is slidable on the clamping frame by means of pushing mechanisms so as to insert a plurality of walled pipes from one position of the clamping frame.

* * * * *